US007071436B2

(12) United States Patent
Coates

(10) Patent No.: US 7,071,436 B2
(45) Date of Patent: Jul. 4, 2006

(54) STARTER

(75) Inventor: Paul David Coates, Darlington (GB)

(73) Assignee: Electrolux Outdoor Products Limited, Newton Aycliffe (GB)

( * ) Notice: Subject to any disclaimer, the term of this patent is extended or adjusted under 35 U.S.C. 154(b) by 13 days.

(21) Appl. No.: 10/885,945

(22) Filed: Jul. 7, 2004

(65) Prior Publication Data

US 2005/0023834 A1 Feb. 3, 2005

(30) Foreign Application Priority Data

Jul. 7, 2003 (GB) ..... 0315855.7

(51) Int. Cl.
*H01H 13/14* (2006.01)

(52) U.S. Cl. ..... 200/341; 200/334; 200/43.04; 200/330

(58) Field of Classification Search ..... 200/341–345, 200/330, 334, 43.01, 43.03, 43.04, 43.18
See application file for complete search history.

(56) References Cited

U.S. PATENT DOCUMENTS

| | | | | |
|---|---|---|---|---|
| 5,089,671 | A * | 2/1992 | Ranetkins | 200/5 A |
| 5,357,070 | A * | 10/1994 | Parsons, Jr. | 200/331 |
| 5,444,199 | A | 8/1995 | Burchard et al. | |
| 5,587,569 | A | 12/1996 | Mohtasham | |
| 6,013,881 | A * | 1/2000 | Hall et al. | 200/43.04 |
| 6,198,058 | B1 * | 3/2001 | Graninger et al. | 200/50.02 |
| 6,307,167 | B1 * | 10/2001 | Kajio et al. | 200/43.11 |
| 6,720,508 | B1 * | 4/2004 | Moriyama et al. | 200/200 |

FOREIGN PATENT DOCUMENTS

| | | |
|---|---|---|
| DE | 40 39 652 C1 | 3/1992 |
| GB | 2 091 043 A | 7/1982 |
| GB | 2 120 016 A | 11/1983 |

* cited by examiner

*Primary Examiner*—Richard K. Lee
(74) *Attorney, Agent, or Firm*—Pearne & Gordon LLP

(57) ABSTRACT

An electric starter for an internal combustion engine comprises a switch (1) connectable to the starter motor of the engine, an actuator (3) for actuating the switch, and a removable operating element (4) for operating the actuator. The actuator (4) is a push-button actuator.

7 Claims, 1 Drawing Sheet

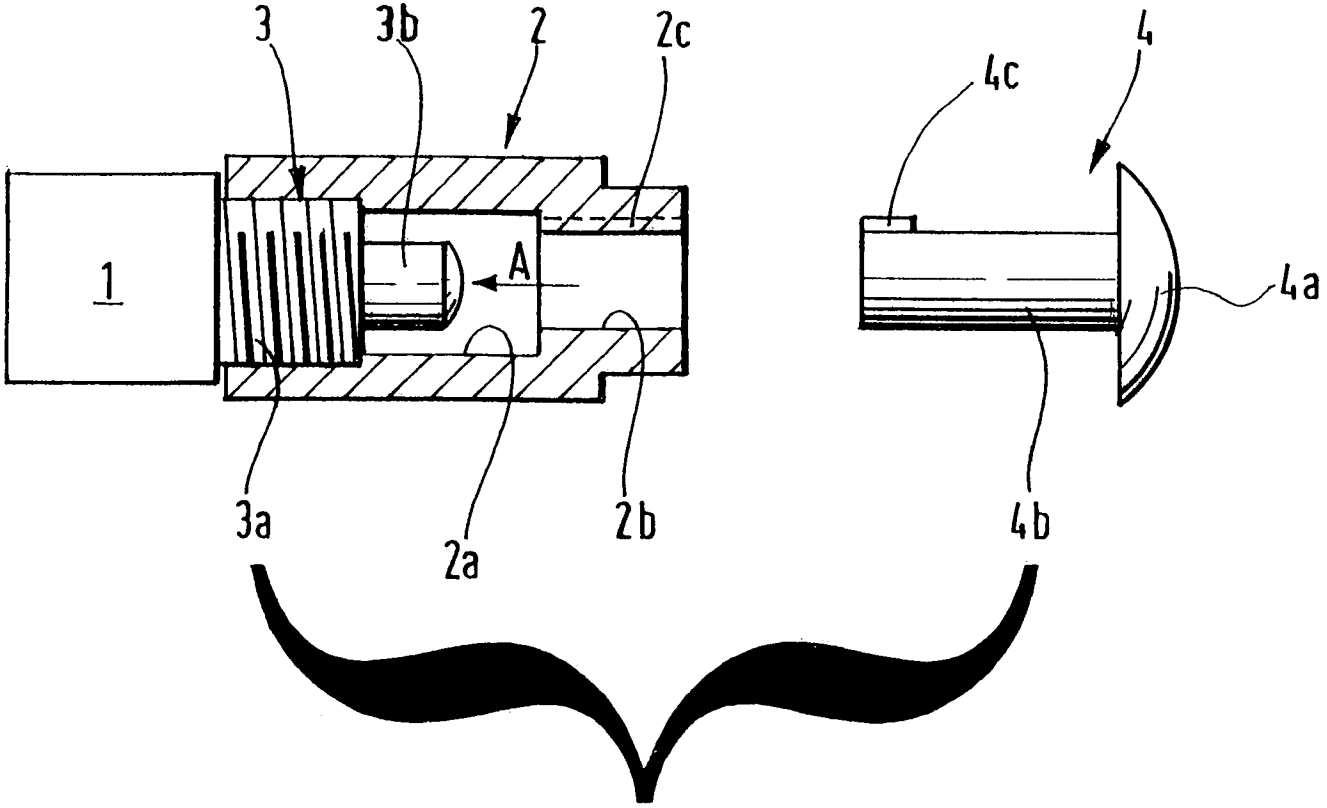
Figure

STARTER

This invention relates to an electric starter for a petrol powered lawnmower.

A conventional petrol lawnmower is provided with a pull cord for starting the internal combustion engine of the lawnmower. This pull cord starter arrangement can be supplemented by the provision of an electric starter switch, the switch being operated by means of a key turning in a key slot provided in the switch housing. Such a switch is connected at one end of a wiring harness, with the engine starter motor and battery at the opposite end of the harness.

One disadvantage of this known electric starter switch is that it is a relatively complicated and expensive construction. Moreover, there is a danger of the key being hit in use, which could lead to the key being broken within the key slot, in which case, a relatively costly repair would be necessary.

The present invention provides an electric starter for an internal combustion engine, the starter comprising a switch connectable to the starter motor of the engine, an actuator for actuating the switch, and a removable operating element for operating the actuator, wherein the actuator is a push-button actuator.

Preferably, the actuator is mounted within a hollow housing associated with the switch, and the operating element is reciprocally mounted within the housing. Conveniently, the operating element has a shaft, and one end of the housing is provided with an aperture leading to its hollow interior, the aperture complementing the cross-section of the shaft, the shaft and the aperture being formed with complementary, interengageable projection/recessed portions.

Advantageously, the operating element is provided with a manually-engageable head portion at that end of the shaft remote from the key projection.

Advantageously, the body portion of the actuator is fixed within the housing by means of a screw-threaded connection. Alternatively, the body portion of the actuator is fixed within the housing by snap-fitting.

Preferably, the actuator has a body portion fixed to the switch, and an actuator portion reciprocally mounted within the body portion for movement towards, and away from, the switch. Preferably, the housing is fixed to the body portion of the actuator with the actuator portion positioned within its hollow interior and in alignment with the aperture in said one end of the housing.

The invention will now be described in greater detail, by way of example, with reference to the drawing, the single figure of which is a schematic representation of a petrol lawnmower electric starter switch arrangement.

Referring to the drawing, an electric switch 1 for starting the internal combustion engine of a petrol powered lawnmower (not shown) is mounted within a housing 2. The switch 1 is provided with a push button actuator 3 having a body 3*a* and a push button 3*b* mounted for reciprocal movement within the body. A spring (not shown) is provided within the switch 1 to bias the push button 3*b* towards the position shown in the drawing. In order to actuate the switch 1, it is necessary to push the button 3*b* in the direction of the arrow A. The body 3*a* of the push button 3 is fixed within a bore 2*a* of the housing 2 by means of a screw-threaded connection. Alternatively, the body 3*a* of the push button actuator 3 is a snap fit within the housing 2.

A removable button key 4 is provided for engagement with the actuator 3 to actuate the switch 1. The key 4 has a head 4*a*, generally cylindrical shaft 4*b*, and a key projection 4*c*. The bore 2*a* of the housing 2 has a stepped-in portion 2*b* at its free end, the diameter of this stepped-in portion being slightly greater than that of the shaft 4*b* of the key 4. A slot 2*c*, which complements the key projection 4*c*, is provided in the stepped-in portion 2*b*.

In use, the key projection 4*c* of the key 4 is aligned with the slot 2*c*, and the key is pushed into the housing 2. Once the key projection 4*c* enters the bore 2*a* of the housing 2, the key 4 can be rotated to hold the key with in the housing, thereby preventing the key becoming accidentally loose in use. To start the lawnmower, the key 4 is then pressed into the housing 2 as far as possible, thereby pushing the button 3*b* in the direction of the arrow A against the force of the spring, and actuating the switch 1 to fire the engine starter motor.

Once the lawnmower engine has started, pressure on the key 4 is relaxed, the button 3*b* returns to the position shown in the drawing under the action of the spring, and the key is held as a loose fit within the housing 2. A separate switch (not shown) known as an operator presence control or dead man's handle is provided for turning off the engine of the lawnmower.

The main benefits of the electric starter switch arrangement described above are that it is cheaper to manufacture, and much simpler to operate than the known ignition key system, whilst maintaining the same safety advantages. Thus, the housing 2 and the key 4 can be manufactured very simply and cheaply by moulding processes using a plastics material such as glass-filled nylon or ABS, and the push button actuator 3 is a cheap and simple part to manufacture.

The invention claimed is:

1. An electric starter for an internal combustion engine, the starter comprising a switch connectable to the starter motor of the engine, a push-button actuator for actuating the switch, and a removable operating element for operating the actuator, the actuator being mounted within a housing associated with the switch, and the operating element being reciprocally mounted within the housing, wherein the operating element has a shaft and one end of the housing is provided with an aperture leading to its hollow interior, the aperture complementing the cross-section of the shaft, the shaft and the aperture being formed with complementary, interchangeable projection/recessed portions.

2. A starter as claimed in claim 1, wherein the shaft is formed with an outwardly-extending key projection at one end thereof, and the aperture is formed with an outwardly-recessed portion whose shape complements that of the key projection.

3. A starter as claimed in claim 2, wherein the body portion of the actuator is fixed within the housing by means of a screw-threaded connection.

4. A starter as claimed in claim 2, wherein the body portion of the actuator is fixed within the housing by snap-fitting.

5. A switch as claimed in claim 2, wherein the housing is fixed to the body portion of the actuator with the actuator portion positioned within its hollow interior and in alignment with the aperture in said one end of the housing.

6. A starter as claimed in claim 1, wherein the operating element is provided with a manually-engageable head portion at that end of the shaft remote from the key projection.

7. A starter as claimed in claim 1, wherein the actuator has a body portion fixed to the switch, and an actuator portion (push button) reciprocally mounted within the body portion for movement towards, and away from, the switch.

* * * * *

US007071436C1

(12) EX PARTE REEXAMINATION CERTIFICATE (10767th)

United States Patent

Coates

(10) Number: US 7,071,436 C1

(45) Certificate Issued: Nov. 24, 2015

(54) STARTER

(75) Inventor: Paul David Coates, Darlington (GB)

(73) Assignee: HUSQVARNA AB, Huskvarna (SE)

Reexamination Request:
No. 90/013,330, Sep. 3, 2014

Reexamination Certificate for:

| | |
|---|---|
| Patent No.: | **7,071,436** |
| Issued: | **Jul. 4, 2006** |
| Appl. No.: | **10/885,945** |
| Filed: | **Jul. 7, 2004** |

(30) Foreign Application Priority Data

Jul. 7, 2003 (GB) ..... 0315855.7

(51) Int. Cl.
*H01H 13/14* (2006.01)
*H01H 27/00* (2006.01)

(52) U.S. Cl.
CPC ..... *H01H 27/00* (2013.01)

(58) Field of Classification Search
None
See application file for complete search history.

(56) References Cited

To view the complete listing of prior art documents cited during the proceeding for Reexamination Control Number 90/013,330, please refer to the USPTO's public Patent Application Information Retrieval (PAIR) system under the Display References tab.

*Primary Examiner* — Jeffrey L Gellner

(57) ABSTRACT

An electric starter for an internal combustion engine comprises a switch (1) connectable to the starter motor of the engine, an actuator (3) for actuating the switch, and a removable operating element (4) for operating the actuator. The actuator (4) is a push-button actuator.

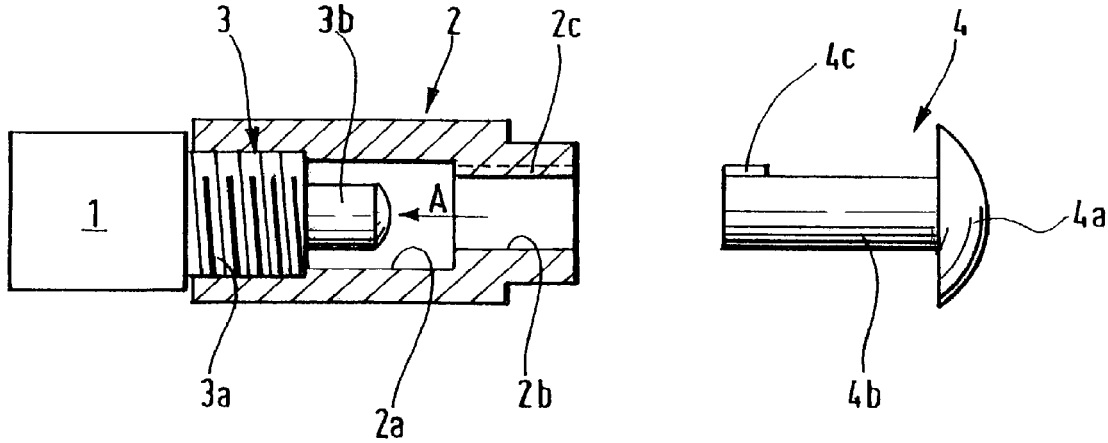

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 7 is cancelled.

Claims 1, 3 and 4 are determined to be patentable as amended.

Claims 2, 5 and 6, dependent on an amended claim, are determined to be patentable.

New claims 8-35 are added and determined to be patentable.

1. An electric starter for an internal combustion engine, the starter comprising a switch connectable to the starter motor of the engine, a push-button actuator for actuating the switch, and a removable operating element for operating the actuator, the actuator being mounted within a housing associated with the switch, and the operating element being reciprocally mounted within the housing, wherein the operating element has a shaft and one end of the housing is provided with an aperture leading to its hollow interior, the aperture complementing the cross-section of the shaft, the shaft and the aperture being formed with complementary, interchangeable projection/recessed portions,

*wherein the actuator has a body portion fixed to the switch, and an actuator portion (push button) reciprocally mounted within the body portion for movement towards, and away from, the switch.*

3. [A starter as claimed in claim 2], *An electric starter for an internal combustion engine, the starter comprising a switch connectable to the starter motor of the engine, a push-button actuator for actuating the switch, and a removable operating element for operating the actuator, the actuator being mounted within a housing associated with the switch, and the operating element being reciprocally mounted within the housing, wherein the operating element has a shaft and one end of the housing is provided with an aperture leading to its hollow interior, the aperture complementing the cross-section of the shaft, the shaft and the aperture being formed with complementary, interchangeable projection/recessed portions*

*wherein the shaft is formed with an outwardly-extending key projection at one end thereof, and the aperture is formed with an outwardly-recessed portion whose shape complements that of the key projection, and* wherein the body portion of the actuator is fixed within the housing by means of a screw-threaded connection.

4. [A starter as claimed in claim 2], *An electric starter for an internal combustion engine, the starter comprising a switch connectable to the starter motor of the engine, a push-button actuator for actuating the switch, and a removable operating element for operating the actuator, the actuator being mounted within a housing associated with the switch, and the operating element being reciprocally mounted within the housing, wherein the operating element has a shaft and one end of the housing is provided with an aperture leading to its hollow interior, the aperture complementing the cross-section of the shaft, the shaft and the aperture being formed with complementary, interchangeable projection/recessed portions*

*wherein the shaft is formed with an outwardly-extending key projection at one end thereof, and the aperture is formed with an outwardly-recessed portion whose shape complements that of the key projection, and* wherein the body portion of the actuator is fixed within the housing by snap-fitting.

*8. A lawnmower comprising a starter as claimed in claim 1.*

*9. A starter as claimed in claim 1, wherein the shaft is generally cylindrical and comprises a key projection, wherein the key projection extends radially outward proximate to one end of the shaft.*

*10. A starter as claimed in claim 1, wherein the operating element is held as a loose fit within the housing after movement of the operating element to operate the actuator.*

*11. A starter as claimed in claim 1, wherein the operating element is displaced toward the switch to actuate the actuator responsive to placement of pressure on the operating element, and wherein the operating element returns in a direction away from the switch to be held within the housing after the pressure is relaxed.*

*12. A starter as claimed in claim 1, wherein the body portion of the actuator is fixed within a bore of the housing.*

*13. A starter as claimed in claim 1, wherein the switch is actuated responsive to the actuator portion being moved linearly away from the aperture in one end of the housing.*

*14. A starter as claimed in claim 1, wherein the switch is actuated responsive to the actuator portion being moved linearly relative to the housing.*

*15. A starter as claimed in claim 1, wherein the actuator portion is positioned within the housing and in alignment with the aperture in one end of the housing.*

*16. A starter as claimed in claim 1, wherein the starter further comprises a spring to bias the actuator portion toward the aperture in one end of the housing.*

*17. A starter as claimed in claim 1, wherein actuating the switch requires pressing the operating element into the housing as far as possible, thereby pushing a push button of the push-button actuator toward the switch.*

*18. A starter as claimed in claim 1, wherein the starter is provided on a petrol powered lawnmower, and wherein the lawnmower further comprises an operator presence control to turn off the engine of the lawnmower.*

*19. A starter as claimed in claim 1, wherein the operating element is made of plastic.*

*20. A starter as claimed in claim 1, wherein the housing is made of plastic.*

*21. A starter as claimed in claim 1, wherein the switch is mounted within the housing.*

*22. A starter as claimed in claim 1, wherein the switch is actuated responsive to the operating element being moved linearly to operate the push-button actuator.*

*23. An electric starter for an internal combustion engine, the starter comprising a switch connectable to the starter motor of the engine, a push-button actuator for actuating the switch, and a removable operating element for operating the actuator, the actuator being mounted within a housing associated with the switch, and the operating element being reciprocally mounted within the housing, wherein the operating element has a shaft and one end of the housing is provided with an aperture leading to its hollow interior, the aperture complementing the cross-section of the shaft, the shaft and the aperture being formed with complementary, interchangeable projection/recessed portions,*

*wherein the actuator comprises an actuator portion and a body portion, wherein the actuator portion is a push button that is reciprocally mounted within the body portion for movement towards, and away from, the switch, and wherein the switch is actuated responsive to the operating element being moved linearly to push the push button.*

*24. A starter as claimed in claim 23, wherein the housing comprises a stepped-in portion, wherein the shaft is generally cylindrical and comprises a first diameter, wherein the stepped-in portion comprises a second diameter that is slightly greater than the first diameter of the shaft, and wherein the switch is actuated responsive to the shaft being moved linearly through the stepped-in portion to operate the push-button actuator.*

*25. An electric starter for an internal combustion engine of a lawnmower, the starter comprising:*

*a housing made of plastic and defining an aperture at one end thereof, the aperture leading to a hollow interior of the housing;*

*a switch mounted within the housing and connectable to a starter motor of the internal combustion engine;*

*a push-button actuator for actuating the switch, wherein the push-button actuator is mounted within the housing, wherein the push-button actuator comprises a body portion and an actuator portion, wherein the actuator portion is reciprocally mounted within the body portion, and wherein the actuator portion is in alignment with the aperture;*

*a spring for biasing the actuator portion towards the aperture; and*

*a removable operating element for operating the push-button actuator responsive to movement of the removable operating element linearly in the aperture from a first position to a second position, wherein the removable operating element is reciprocally mounted within the housing, wherein the removable operating element is made of plastic and comprises a head portion and a shaft, and wherein the head portion is closer to the body portion of the push-button actuator in the second position than in the first position,*

*wherein the removable operating element moves from the first position to the second position responsive to application of pressure on the head portion of the removable operating element, and moves from the second position to the first position under force of the spring when the application of pressure is relaxed, and*

*wherein the shaft comprises a projection extending away from the shaft, and wherein the aperture is formed with a recessed portion to complement the projection of the shaft.*

*26. A lawnmower comprising a starter as claimed in claim 25.*

*27. A starter as claimed in claim 25, wherein the removable operating element is held as a loose fit within the housing after movement of the removable operating element to operate the push-button actuator.*

*28. A starter as claimed in claim 25, wherein the actuator portion is a push button that is reciprocally mounted within the body portion for movement towards, and away from, the switch, and wherein the switch is actuated responsive to the operating element being moved linearly to push the push button.*

*29. A starter as claimed in claim 25, wherein the housing comprises a stepped-in portion, wherein the shaft is generally cylindrical and comprises a first diameter, wherein the stepped-in portion comprises a second diameter that is slightly greater than the first diameter of the shaft, and wherein the switch is actuated responsive to the shaft being moved linearly through the stepped-in portion to operate the push-button actuator.*

*30. A starter as claimed in claim 25, wherein the removable operating element is rotatable within the housing.*

*31. A starter as claimed in claim 25, wherein the switch is connected to the starter motor of the engine by a wiring harness.*

*32. A starter as claimed in claim 25, wherein the spring is provided within the switch.*

*33. A starter as claimed in claim 16, wherein the spring is provided within the switch.*

*34. A starter as claimed in claim 1, wherein the operating element is rotatable within the housing.*

*35. A starter as claimed in claim 1, wherein the switch is connected to the starter motor of the engine by a wiring harness.*

* * * * *